US006217259B1

(12) United States Patent
Godbersen

(10) Patent No.: US 6,217,259 B1
(45) Date of Patent: Apr. 17, 2001

(54) PORTABLE MODULAR DOCK SYSTEM

(76) Inventor: Byron L. Godbersen, Lake LaJune Estates, Ida Grove, IA (US) 51445

( * ) Notice: Subject to any disclaimer, the term of this patent is extended or adjusted under 35 U.S.C. 154(b) by 0 days.

(21) Appl. No.: 09/351,693

(22) Filed: Jul. 13, 1999

(51) Int. Cl.[7] ..... E02B 3/20
(52) U.S. Cl. ..... 405/218; 405/220
(58) Field of Search ..... 405/1, 2, 3, 4, 405/5, 218, 219, 220, 221; 52/78, 87, 269, 177, 122.1, 125.1, 126.1; 182/141, 142

(56) References Cited

U.S. PATENT DOCUMENTS

| | | | | |
|---|---|---|---|---|
| 2,948,121 | * | 8/1960 | Karst | 61/48 |
| 4,008,506 | * | 2/1977 | Smith | 52/645 X |
| 4,087,977 | | 5/1978 | Kuhlman . | |
| 4,126,006 | * | 11/1978 | Lewis | 405/220 |
| 4,174,187 | | 11/1979 | Parisien . | |
| 4,398,849 | * | 8/1983 | Moran et al. | 405/221 |
| 4,645,380 | * | 2/1987 | Hambrick et al. | 405/220 |
| 4,948,300 | * | 8/1990 | Bateson | 405/220 |
| 4,968,182 | * | 11/1990 | Westwell | 405/215 |
| 5,788,416 | | 8/1998 | Wolgamot . | |

* cited by examiner

*Primary Examiner*—Robert E. Pezzuto
(74) *Attorney, Agent, or Firm*—Henderson & Sturm LLP

(57) ABSTRACT

A portable modular boat dock system of improved assembly and disassembly, which comprises a plurality of dock sections, a leg supporting unit for pivotal, detachable connection to a shoreward end of each dock section, a releasable latching unit for connection of adjacent dock sections to prevent both vertical and lateral relative movement, a lever-releasable unit for extending a telescoping foot for each leg for lake bed height adjustment, and improved accessory mounting structure. This system provides for simple installation of the dock without use of wheels, floats or standard tools.

15 Claims, 8 Drawing Sheets

106
102
107

103
104
57
56
98
117
114
113
116
126
101
66
102

103
104
57
13
13
58
98
56
122
121
129
128
113
112
109
117
102
107
124
106
123
118
119
119
101
108
109
111
126
66
104
57

106
107
58
103
98
114
116
114
112
127
66
108
109

PORTABLE MODULAR DOCK SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates generally to docks for use by pleasure craft and the like, and more particularly to modular docks.

2. Description of the Related Art

Boat docks are well known in the art, as are portable, modular dock systems adapted for installation off the shoreline of a river or lake bed, normally in the spring in the North and Midwestern areas of the United States, and for removal in the early winter, before ice forms.

Numerous constraints are placed on the design and structure of modular docks due to these factors, plus those of shoreline terrain, water depth, the availability of manual help and tools.

Contemporary dock systems include the use of wheels which roll the lakeward end of a dock section into the water, flotation arrangements, and various types of hinges which permit dock sections to swing or pivot through vertical planes. Not only have all of these prior systems proved difficult to assemble and install, they have also required many man hours and various tools.

Various latches, brackets, screws and like hardware have been used for such installation and removal purposes, however, all have been found wanting as to ease, economy and simplicity of installation, and as to durability. It is to the improvement of these shortcomings of prior modular dock systems that this invention is directed.

BRIEF SUMMARY OF THE INVENTION

The present invention provides a plurality of dock sections each of which is provided with a fixed, female flange extended transversely across a lakeward end of the section, and a leg unit having at least a pair of legs interconnected with a fixed, male flange extended transversely between the legs and which male flange is adapted to be snapped into engagement with the female flange whereby each lakeward end of each dock section has a pair of river or lake bottom engaging legs. The interconnected legs are stabilized in their position depending substantially at right angles to the dock section by a pair of stabilizer bars interconnected between the underside of the dock section and a lower part of each leg.

The opposite end of each dock section is further provided with a latching flange unit including a spring-biased locking pin, the flange unit capable of being hand manipulated to both releasably engage with a portion of the male flange of an adjacent dock section for preventing relative longitudinal movement between the joined dock sections, and to lock the adjacent dock sections together against relative vertical and lateral movement therebetween.

The invention provides further a leg unit extension feature comprising a foot tube telescopically mounted within a leg tube, and a lever inserted through common sides of the leg tube and foot tube, into the interior of the foot tube, and movable between a foot tube released position where the foot tube is movable longitudinally within the leg tube, and a locked position wherein the lever holds the foot tube in a cammed manner against such relative movement, such that a firm stable dock stance is provided. The lever is releasable against a spring bias to the foot tube released position.

The invention provides still another feature in the form of a plurality of projections mounted upon each leg, on which a universal mounting bracket may be removably secured, each bracket capable of supporting one or more dock accessories such as benches, guide poles, fishing seats and the like.

Therefore, an object of this invention is to provide an improved, portable modular dock system.

Another object is to provide a dock system which provides for a simple but effective leg installation onto each dock unit providing a stable dock stance.

A further object of this invention is to provide a system which has either a plurality of wood or plastic dock sections, each of which can be floated into place adjacent a previously installed section, readily inverted and easily but securely connected to an adjacent dock section and readily locked against relative vertical and lateral movement.

Still another object of this invention is a system which provides for semi-automatic positioning of a foot of each leg unit on the water bed, providing a firm, stable dock stance while in use; and further providing for a dock-mounted releasing manipulation of the foot whereby the foot may be raised or lowered relative to the leg unit, then re-locked in place, weight of the dock enhancing the clamping action of the leg unit.

Yet another object of this invention is the provision of a portable, modular dock system, the assembly, installation, removal and disassembly of which does not require the use of a single conventional tool.

Other objects, advantages, and novel features of the present invention will become apparent from the following detailed description of the invention when considered in conjunction with the accompanying drawings.

DETAILED DESCRIPTION OF THE INVENTION

Figure 1:
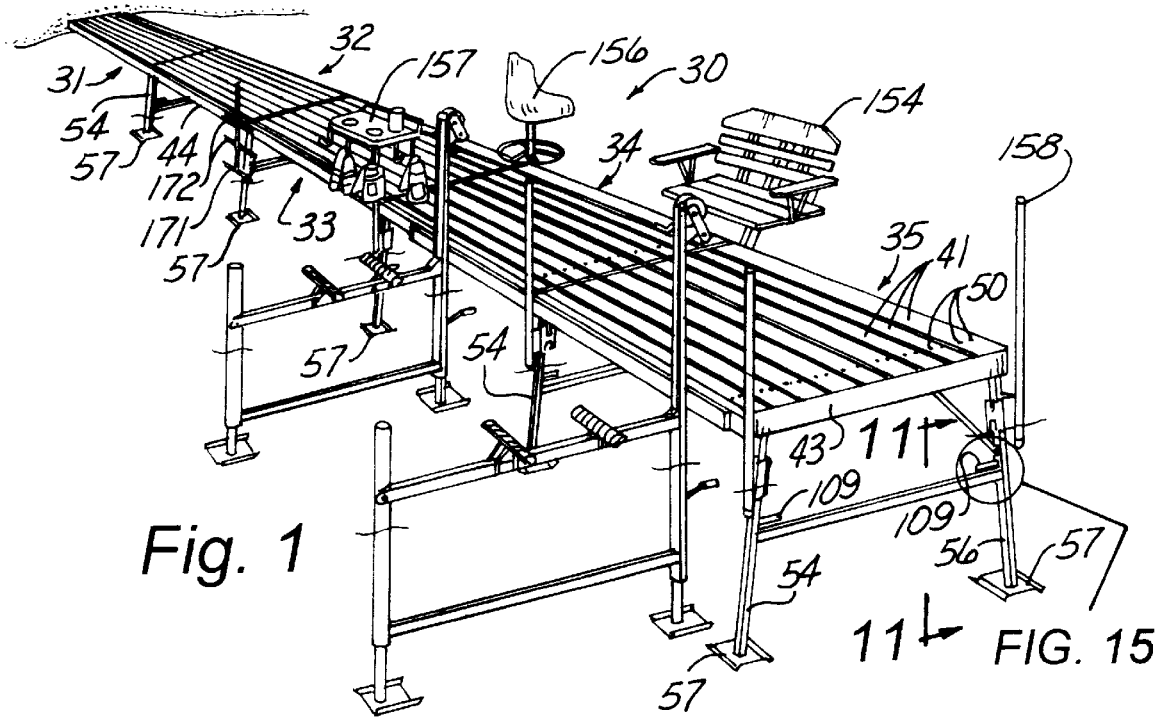
FIG. 1 is a perspective view of my new dock system, to which a dock-mounted hoist is attached.
Figure 4:
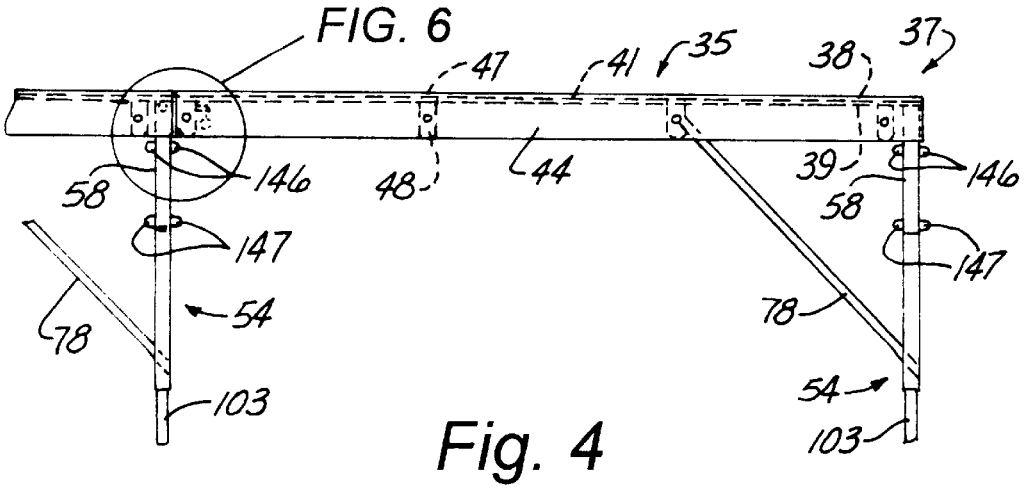
FIG. 4 is a fragmentary side elevational view of the end section of FIG. 1.

Referring now to the drawings, wherein like reference numerals designate identical or corresponding parts throughout the several views, FIG. 1 shows one embodiment of the portable, modular dock system (30) of this invention comprising a plurality, five in this instance, of substantially identical, rectangular dock sections (31)–(35), each dock section having a shoreward end (36) and a lakeward end (37) opposed to the shoreward end (36), and having a top surface (38) (FIG. 4) and a bottom surface (39).

Each dock section, (35) (FIG. 2) for example, includes a plurality of identical elongated cedar wood planks (41) laid side-by-side, with the lakeward-most section (35) having a lakeward end vertically disposed, trim plank (43), and vertically disposed opposed sideboards (44), (46). The other dock sections (31–34) do not have a trim plank (43). Transverse, metal bars (47) are longitudinally spaced the length of each dock section, with depending side elements (48), to which the planks (41)–(46) are fastened on top, as by carriage boats (50).

Figure 6:
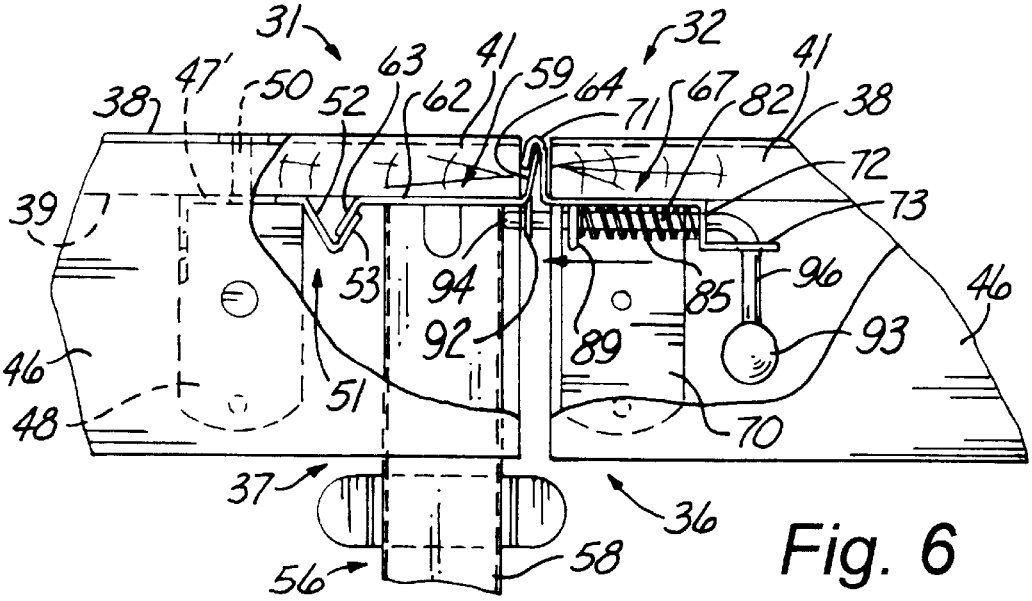
FIG. 6 is a view similar to FIG. 5, and wherein the dock sections are releasably latched together, a portion of the dock sections cut away.

At the lakeward end (37) of each dock section, the bar (47') functions as a first assembly (49) in that each flat bar (47') is provided at the lakeward end with an angular element, in cross section, indicated generally at (51) in FIG. 6, comprising a V-shaped flange (52) along the lakeward edge, and with a first portion (53) of the flange (52) spaced downwardly from the bottom surface (39) for a purpose hereinafter described.

Figure 5:
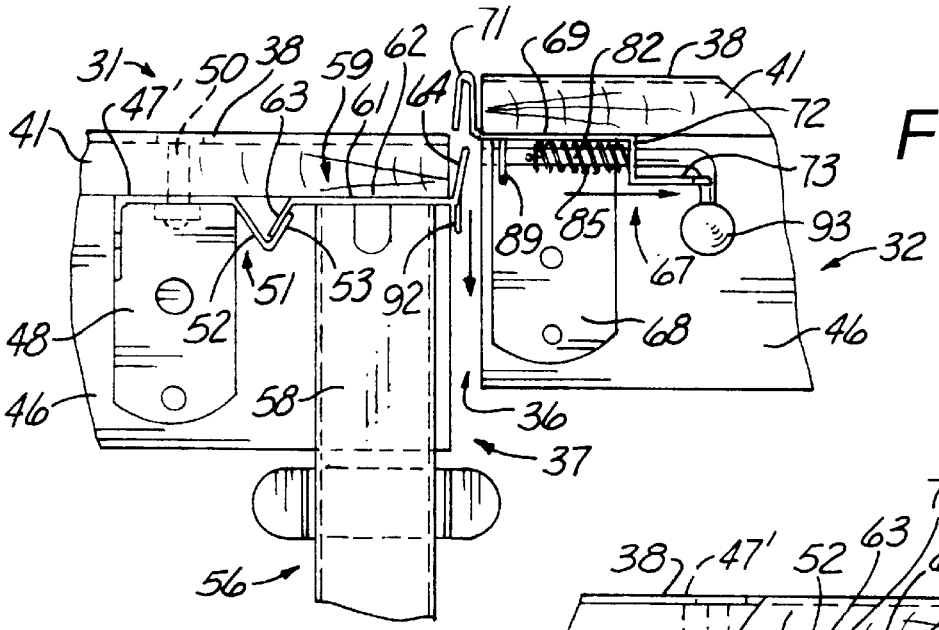
FIG. 5 is an enlarged detail section as encircled in FIG. 1 and showing the latching for releasably locking two dock sections together in a pre-latching condition.

Each dock section (31)–(35) is also provided with a pair of identical leg units (54), (56) (FIG. 1), each leg unit (54), (56) having a lake or river bed engaging foot (57) at a lower end, and having an upper end (58) (FIG. 6), the leg units (54), (56) interconnected across their upper ends (58) by a second assembly (59). The second assembly (59) comprises an elongated second member (61) having, in cross section, a flat portion (62), a shoreward flange (63) extended downwardly and angularly outwardly (see FIG. 6) at an obtuse angle, and a lakeward end (64) extended beyond the dock section lakeward end (37), and extended upwardly and spaced outwardly of the end (37) as best illustrated in FIGS. 5 and 6. An exception is made at the lakeward end (37) of the outermost dock section (35) (FIGS. 2 and 7) wherein the lakeward flange (64') depends downwardly and serves as a fastening element for the end trim plank (43).

Figure 2:
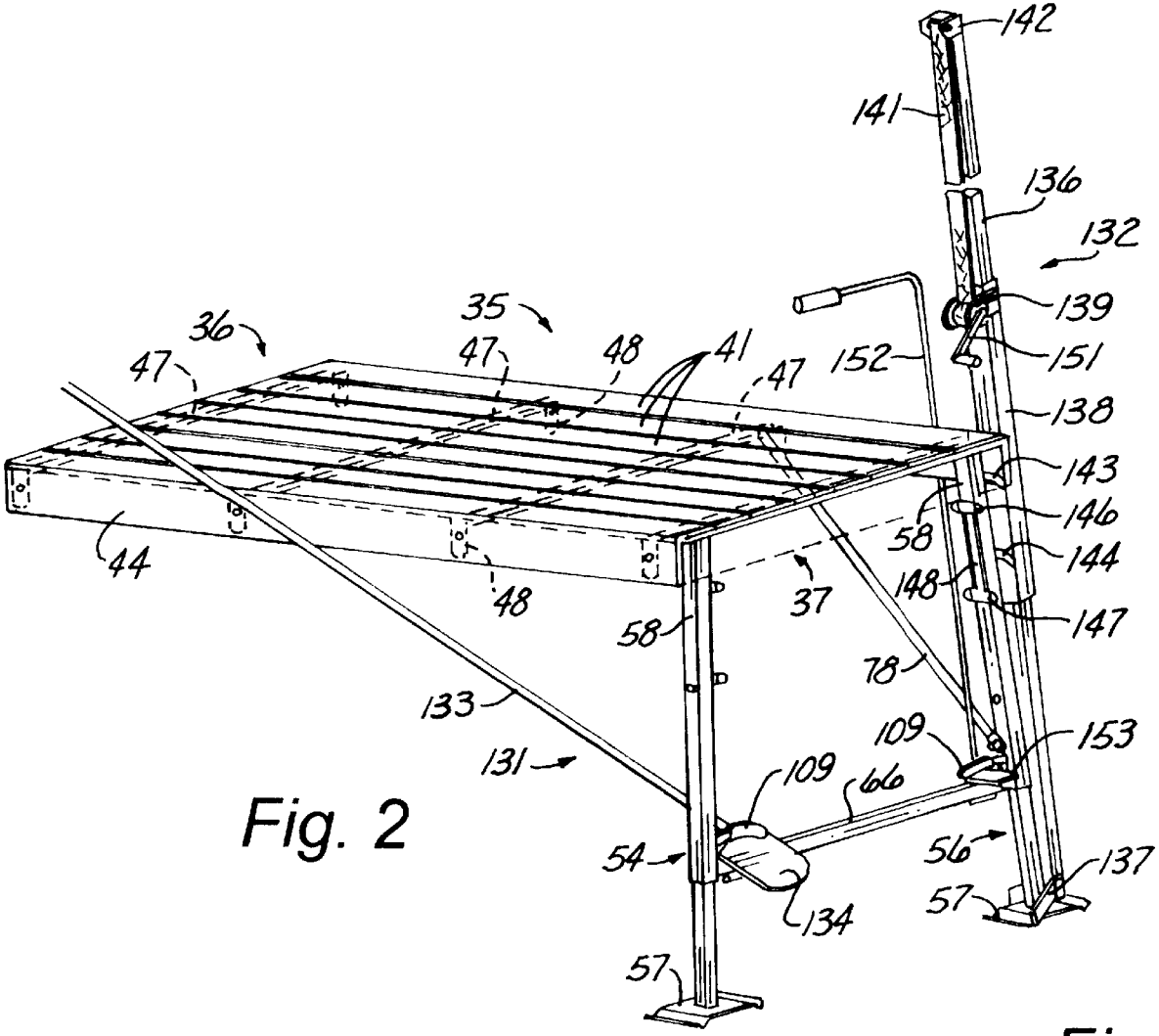
FIG. 2 is an enlarged perspective of the end section of my dock system, to which a leveling winch unit has been attached.

Referring to FIGS. 1 and 2, it will be noted the leg units (54) and (56) are spread slightly further apart at their feet (57) than at their upper ends (58), for purposes of stability, and are also interconnected at midpoints by a brace (66). This wide, A-frame stance, with the width of the base support increasing as the height of the dock system (30) increases, provides greater stability and an added measure of safety.

At the shoreward end (36) of each dock section, except for the innermost dock section (31), a third assembly (67) (FIG. 5) is provided which includes a third member (68) comparable in length to the first bar (47') and the second member (61), the third member (68) having a flat portion (69) with an inverted U-shaped flange (71) extended transversely of and spaced outwardly of the shoreward end (36). The lakeward end of the third member (68) (FIGS. 5 and 7) is L-shaped, having a depending portion (72) and an outwardly extended portion (73). The third member (68) is secured to the ends of the planks (41) by carriage bolts (50) similar to the first bar (47'); and similar to the bars (47), is provided with side elements (70) providing mounting support for the sideboards (44), (46).

Figure 9:
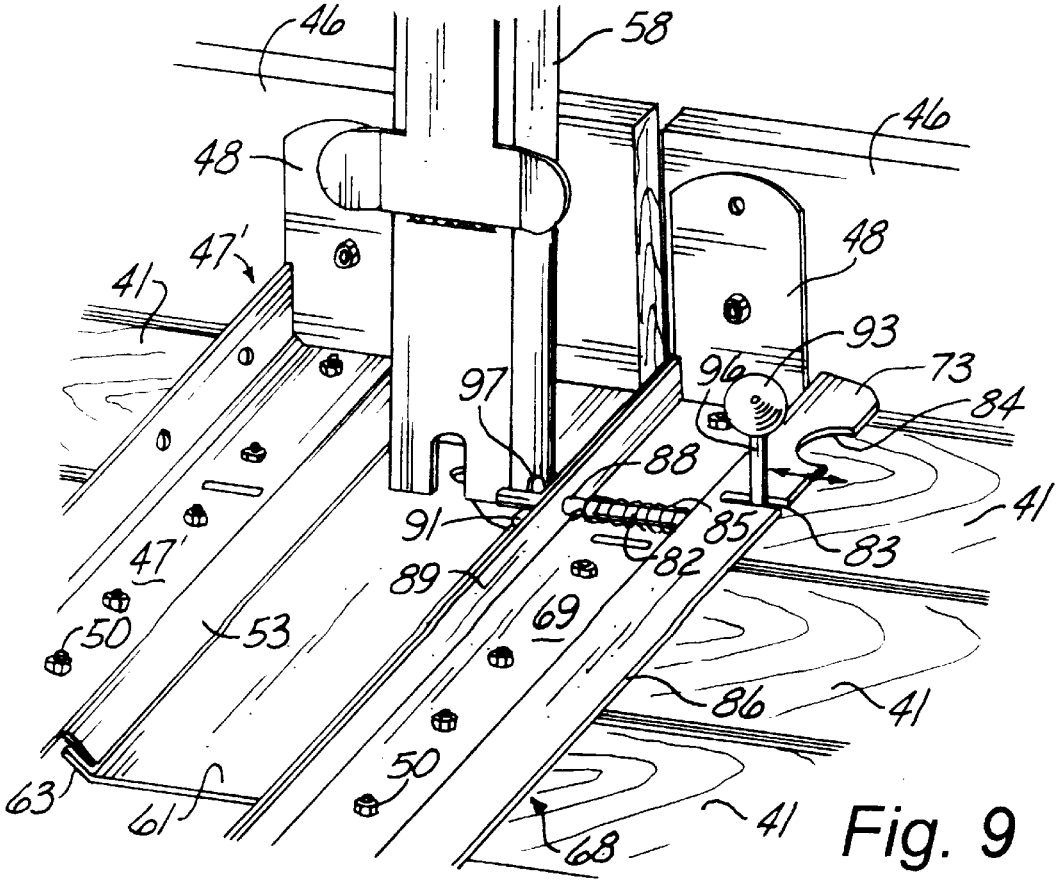
FIG. 9 is a perspective view of the structure of FIG. 8 taken from a different angle.
Figure 10:
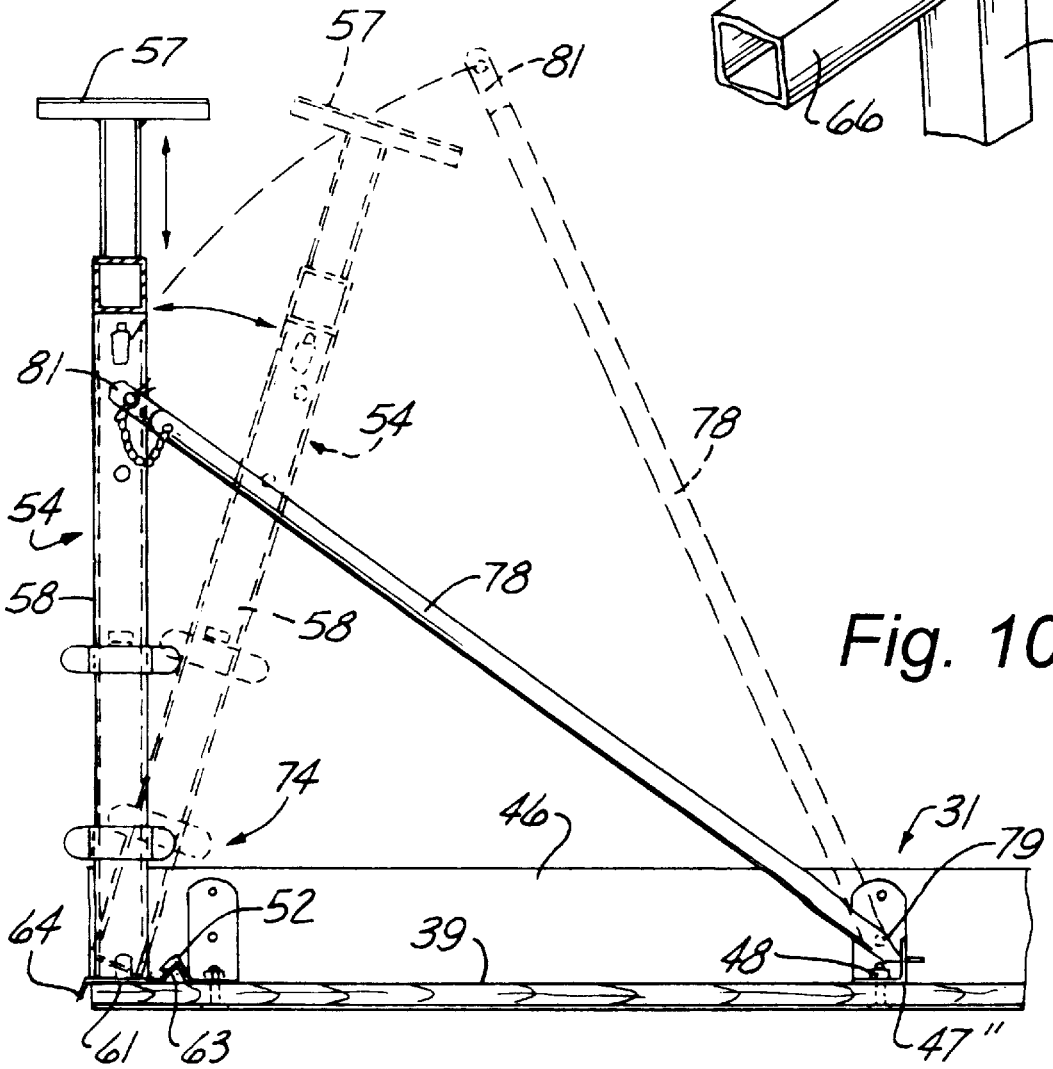
FIG. 10 is a fragmentary elevational view of an inverted dock section and leg unit, dash and full lines showing partial and fully assembled positions.

To assemble the combined leg units (54), (56) and second assembly (59) to a dock section (31), for,example, with the dock section (31) turned upside down as illustrated in FIGS. 9 and 10, the combined structure, indicated generally at (74) in FIG. 10, is placed in an angular position with the dock section bottom surface (39), and with the second member (61) resting on the surface (39) such that the shoreward flange (63) extends through the space between the tip (76) (FIG. 7) of the first bar (47') and the bottom surface (39) and toward the interior of the V-flange (52). This position of the combined structure (74) is shown in dash lines in FIG. 10.

Figure 7:
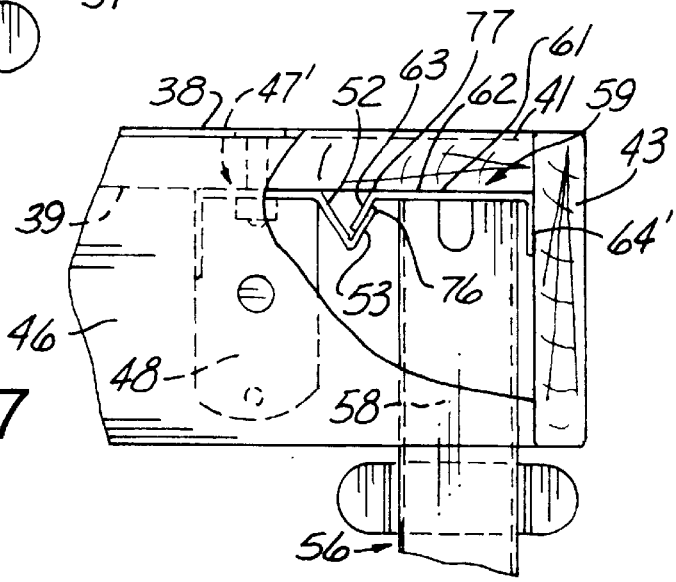
FIG. 7 is a view similar to FIG. 6 and showing an end leg unit engaged with an end dock section.
Figure 15:
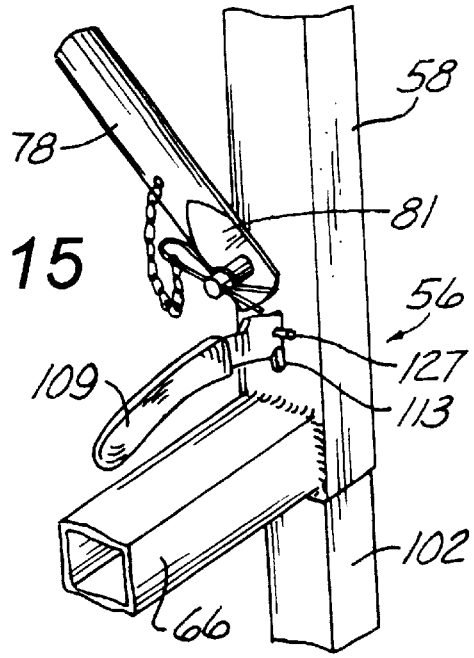
FIG. 15 is a fragmentary perspective view of a structure encircled in FIG. 1.

The combined structure (74) is then rocked in a counterclockwise direction (FIG. 10) toward an upright position about the corner (77) (FIG. 7) of the second member (61) toward and into a clamped, nested condition of the shoreward flange (63) with the V-flange (52) of the first assembly first bar (47'), and wherein the flange (63) is contiguous with the inner surface of the first portion (53), and the second member flat portion (62) is contiguous with the dock section bottom surface (39) (FIG. 7). To brace the combined structure (74) in the upright condition as shown in full lines in FIG. 10, an elongated brace tube (78) has one notched end (79) wedged into a slot (not shown) formed in an adjacent bar (47") with the opposite end (81) fastened in a conventional manner to an adjacent leg unit (56), as best illustrated in FIG. 15.

The dock section (31) for example, is then inverted and placed upright along the shore with the shoreward end (36), resting upon the shore or other structure for providing a substantially even mating with the shore. The outer lakeward end (37) is then in a condition (FIG. 5) for connection with the next adjacent dock section (32). That section (32) is floated in an inverted condition, out to a position in front of the section (31), with the section (32) shoreward end (36) adjacent the section (31); lakeward end (37) readily flipped over due to the offset weight distribution of the leg 15, assembly. The shoreward end (37) of the outer section (32) can then easily be lifted upwardly and moved shorewardly sufficiently to drop the end (37) downwardly, thereby nesting the inner dock section lakeward male flange (64) (FIG. 6) within the female U-flange (71) of the outer dock section 32). Due to the sizing of the parts described, the dock sections respective lakeward and shoreward ends (37) and (36) are thereby placed in an end-to-end abutting relationship, with the respective top surfaces (38) substantially horizontally aligned.

To ensure that the dock sections (31) and (32) are held against vertical and/or lateral movement relative to each other, a spring-biased latch plunger (82) (FIGS. 5 and 6) is provided as part of the third assembly (67). Further, the outwardly extending portion (73) (FIG. 9) has both a slot (83) formed therein and an arcuate cutout (84) also formed therein spaced slightly away from the slot (83). Both the slot (83) and cutout (84) are formed along the outer edge (86) (FIG. 9) of the portion (73). The slot (83) is aligned longitudinally with a passage (87) (FIG. 8) formed through the portion (72) and also aligned with another passage (88) formed in a depending flange (89) of the third member (68). Both passages are longitudinally aligned with the cutout (91) of a tab (92) (FIG. 8) depending from the second member (61).

Figure 8:
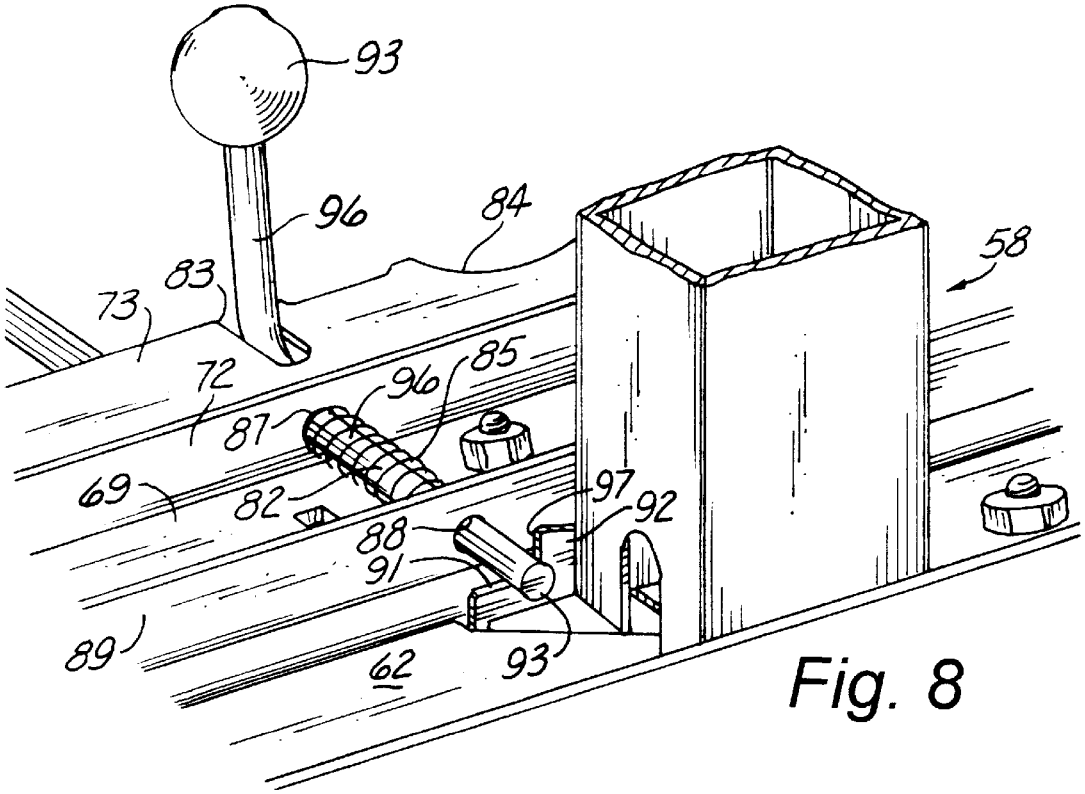
FIG. 8 is a further enlarged fragmentary, perspective view looking upwardly of FIG. 6, and showing an engaged latching unit.

Prior to installation of the two dock sections (31), (32) into an abutting end-to-end relation, the plunger (82) is rotated by a knob (92) to a position (FIG. 5) where the inner end (94) of the plunger (82) is retracted relative to the second member tab (92) (FIG. 5). In this position, the handle (96) of the plunger (82) is held within the cutout (84), against the bias of the spring (85). When the dock sections (31), (32) are placed in the FIG. 6 condition, the handle (94) is then manually rotated to be placed within the slot (83) such as to extend, due to the bias of a spring (85) as illustrated, the handle end (94) shorewardly past the tab (92), and to place it within the tab cutout (91) (FIGS. 8 and 9). With a shoulder (97) of the tab (92) outward of the plunger (82), the plunger (82)—and thus the dock section (32), is prevented from moving laterally outwardly relative to the dock section (31). By having the same spring biased plunger (82) and associated structure on the opposite side and end of the third member (68) in a mirror arrangement the dock section (32) is also prevented from moving the opposite lateral direction from the dock section (31). Further, due to the plunger end (93) being extended inwardly beyond and beneath the tab (92) of the one dock section (31), for example, the dock section (31) and (32) are prevented from relative vertical movement, in conjunction with the nesting of the male and female flanges (64) and (71) (FIG. 6).

Each dock unit (54) and (56) is identical and referring to FIGS. 11–14, only one (56) will be described. The upper section (98) is tubular, with its upper end (58) secured to one end of the second assembly second member (61) as described hereinbefore, and with an opposite, lower end (101) sized to telescopically receive the upper end (102) of an aluminum, U-shaped lower section (103), the lower end (104) of section (103) secured to a foot pad (57) for resting on the water floor. The interior of the lower leg section (103) has a tab (106) (FIGS. 12 and 14) protruding outwardly and downwardly from one-wall (107) adjacent the upper end (102) for purposes described hereafter.

To provide for easy length adjustment of the leg unit (56), whereby the length may be adjusted by hand or dock-positioned rod manipulation, a cam-action lever assembly (108) (FIG. 12) is provided. The assembly (108) comprises, preferably, a lever (109) pivotally mounted within the upper section (98) by a pin (111) extended normal to the lever (109) and engaging a wall (112) of the section (98) on opposite sides of the lever (109), the lever (109) inserted through a vertically extended slot (113) (FIG. 11) formed in the wall (112). The length of the pin (111) is sized such that opposite ends (114), (116) of the pin (111) extend transversely beyond the slot (113) such as to loosely engage the wall (112). In this manner, the lever (109) can be pivoted within a vertical plane about the pin (111) (FIG. 12), and can also be moved within a substantial horizontal plane, side-to-side, in effect, by rocking the pin (111) about its ends (114), (116), as best illustrated in FIG. 13.

Figures 11, 12, 13, 14:
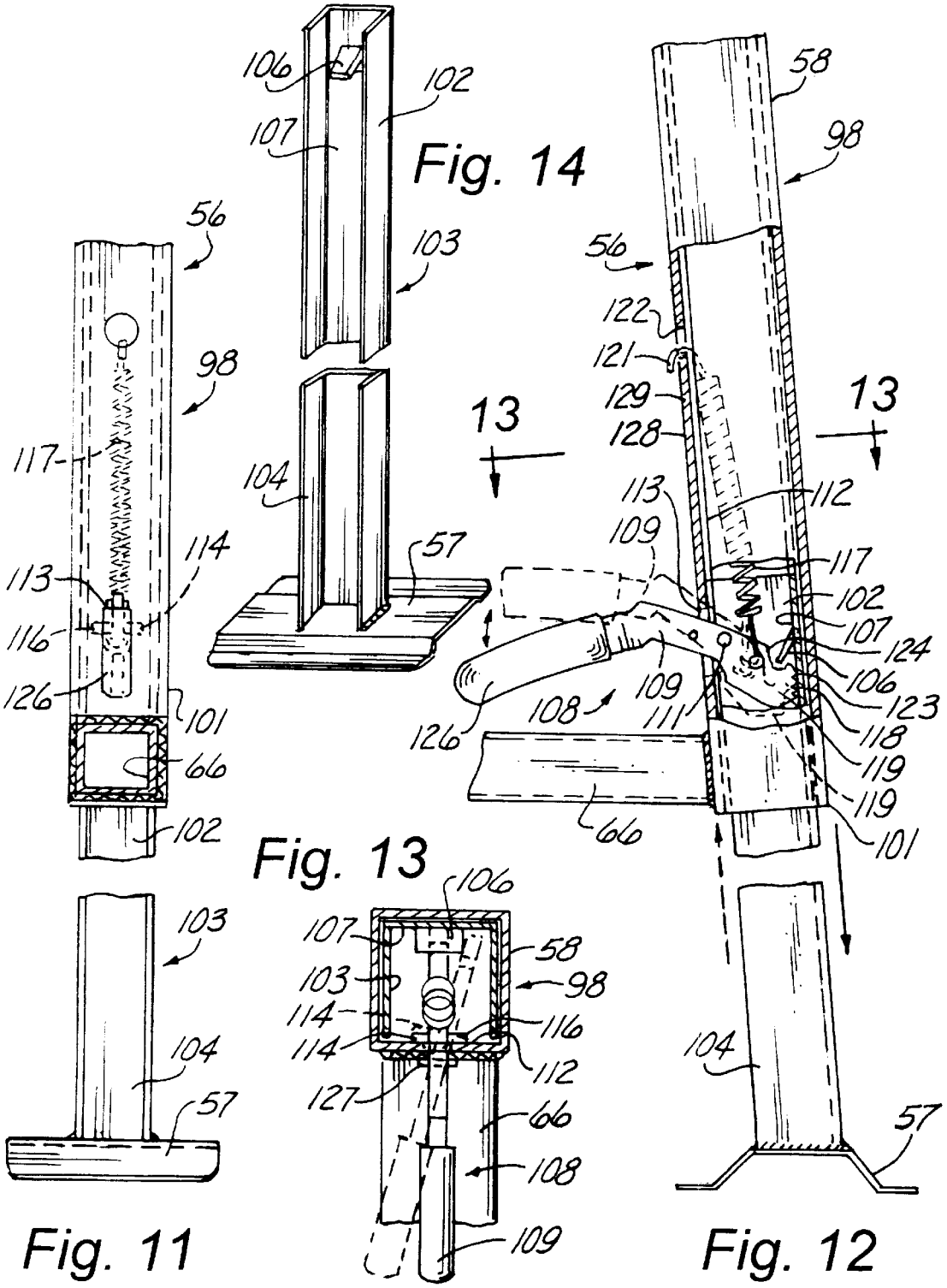
FIG. 11 is a vertical, foreshortened sectional view of a leg unit taken along the line 11—11 in FIG. 1.
FIG. 12 is a vertical, foreshortened, sectional view taken from the front of the leg unit of FIG. 11, with certain parts broken away and other parts in alternate positions.
FIG. 13 is a horizontal sectional view as taken along the line 13—13 in FIG. 12.
FIG. 14 is a detail elevational view, broken, of a dock leg.

The lever (109) is biased about the pin (111) in a counterclockwise direction, as seen in FIG. 12, by a spring (117) the lower end of which is inserted through a hole (118) formed in the inner end (119) of the lever (109), and attached at the upper end (121) to a slot (122) formed in the wall (112) above the lower slot (113). The inner end (119) of the lever (109) has a serrated surface (123) (FIG. 12), with a cutout (124) formed in the upper edge, and the outer end (126) protrudes outwardly of the leg section (98), and is vertically aligned and spaced above the brace (66) (FIG. 12).

To insert the upper end (102) of the lower section (103) into the upper tubular section (98), the lever (109) is rocked within the horizontal plane sufficiently, as shown in FIG. 13, to move the inner lever end (119) laterally whereby upon upward movement of the end (102) within the section (98), the tab (106) can clear and pass by the lever end (119), thereby placing the tab (106) above the lever (109) in the normal condition of the parts. Thus, upon clockwise vertical pivoting movement of the lever (109), the inner serrated lever end (119) is rotated away from engagement by the serrated surface (123) with the inner lower section wall (10), such that the inner leg section (103) can fall downwardly by gravity within the upper leg section (98) until the foot pad (57) reaches the lake bed. The lever (109) is then released, to return to the full line position of FIG. 12 due to the spring (117) bias. It will further be noted that the length of the "fall" or extension of the lower leg section (103) is limited by the tab (106) (FIG. 12) on the section (103) engaging the cutout (124) portion of the lever (109).

To raise any of the dock section lakeward ends (37), the foot pad (57) is held down against the lake bed by a person's foot, or by any other means, the lever (109) is raised by hand or other means to the dotted line position of FIG. 12, to release the engagement of the serrated cam surface (123) with the wall (107), and the dock section end (37) is lifted upwardly until the leg unit (56) is at the proper height, whereupon the lever (109) is again released to reassume its normal, full line position (FIG. 12). It will be noted that weight of the dock section (56) will tend to rotate the lever (109) in a counterclockwise direction about the pin (111), thus further camming the serrated end (123) into the inner leg section wall (107) and further strengthening the locking action of the lever assembly (108).

Figure 3:
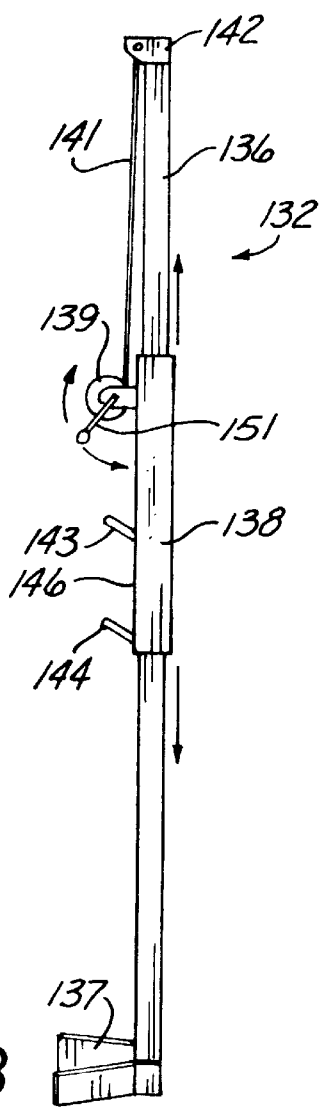
FIG. 3 is a side elevational view of the dock leveling winch unit.

Referring to FIGS. 2 and 3, a pair of units (131) and (132) are illustrated, unit (131) for releasing the lever (109) by a person (not shown) standing on the dock, and the unit (132) for enabling the person to raise the outer end of the dock section (31), for example, at the right leg unit (56). The unit (131) comprises an elongated rod (133) with a flipper paddle (134) at one end. By inserting the paddle (134) between the lever (109) and the brace (66) (see also FIG. 12), and using the brace (66) as a pivot surface, moving the rod (133) in an upward direction will release the lever assembly (108) sufficiently to let the lower leg section (103) fall to assume a further extended position until the lever (109) is released to re-lock the lower leg section (103) within the upper leg section (98). The flipper paddle (132) can then be withdrawn.

The unit (132) is an extension crane comprising a tubular pole (136) with a V-type foot (137) at its lower end, and with a slide housing (138) embracing the pole (131), and raised and lowered by a conventional winch (139) attached to the housing (138), and belt (141) from the winch (139), the upper end of which is secured to the upper end (142) of the pole (136). A pair of vertically spaced projections (143), (144) are secured to the inner face (146) of the housing (138). The projections (143), (144) are sized such that either projection (143) or (144) can be positioned beneath a sideboard (44) or (46). By this arrangement, with the crane unit foot (137) placed upon the leg unit foot pad (57) (FIG. 3), and with the crane unit projections (143), (144) placed below a sideboard, (46) for example, upon raising the housing (138) relative to the stationary crane pole (136), by manual or otherwise rotation of the winch handle (151), the right leg (56) will be lifted upwardly along with the right side, as viewed in FIG. 2, of the dock section (31). To release the lower leg section (103), the flipper paddle rod (133) can be used as described before.

Alternative to the paddle unit (131) (FIG. 2), an elongated bar (152) with a foot (153) secured to and extended at right angles thereto may be used in the same manner as the paddle unit (131) to re-position the extended length of each leg unit lower section (103), should it be desirable to make this adjustment without getting into the water; similarly to use of the crane unit (132) to raise a corner or end of a dock section, again from standing on top of the dock section.

To support various dock accessories, such as a seat unit (154) (FIG. 1), a swivel chair (156) a gear tower and table unit (157), a flag pole or guide pole holder (158) (FIG. 17), a U-shaped bracket (159) is provided, each side flange (161), (162) of the bracket (159) having identical, transversely aligned and vertically spaced pairs of hooks (163), (164) (FIG. 17); the hooks (163), (164) spaced apart both horizontally and vertically, and sized to fit over the ears (146), (147) with the flanges (161), (162) spaced laterally sufficiently to straddle a leg upper end (58), and with the base (166) of the bracket (159) placed contiguous with the outer surface (167) of the leg end (58).

Figure 16:
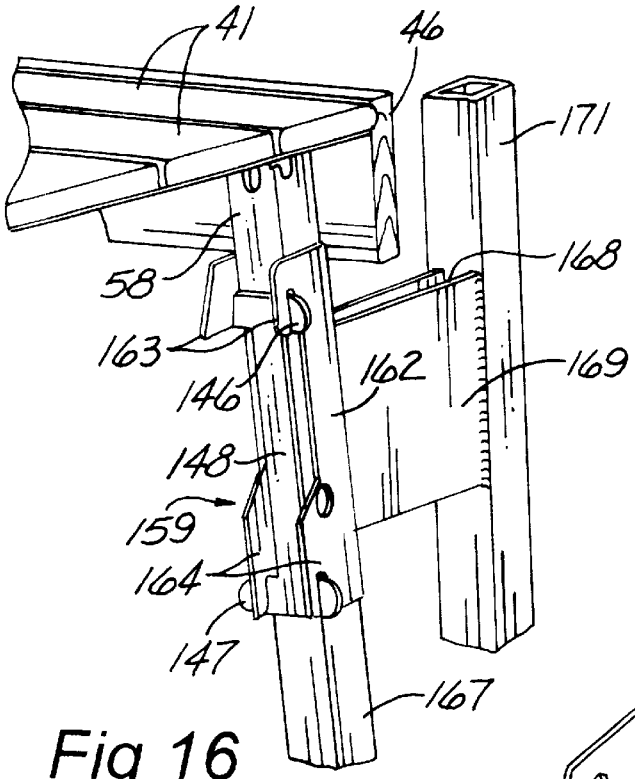
FIG. 16 is a detail, fragmentary perspective view of an accessory brace leg connection.
Figure 17:
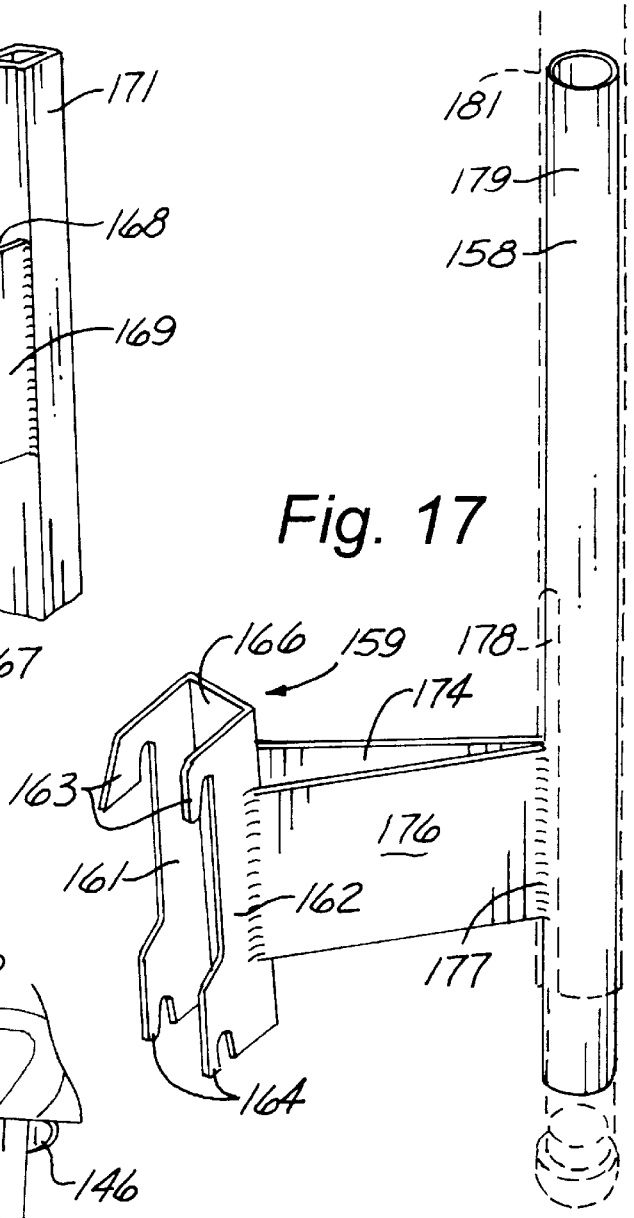
FIG. 17 is a detail, fragmentary perspective view of a guide pole leg brace.

In FIG. 16, the bracket (159) is attached by a pair of plates (168), (169) to a substantially upright elongated tubular member (171), which member (171) has a plurality of steps (172) (FIG. 1) secured thereto in vertically spaced positions, whereby a step ladder unit (173) is formed for egress from and ingress onto a dock section. In FIG. 17, the bracket plates (174), (176) form a V with the apex (177) slidably inserted into a slot (178) formed within the elongated holder (179). By this arrangement, the holder (179) may be adjusted longitudinally of the bracket (159). The holder (179) may function as a guide pole (158) FIG. 1, or it may serve as a base for a swivel seat outer tubular member (181).

Figure 18:
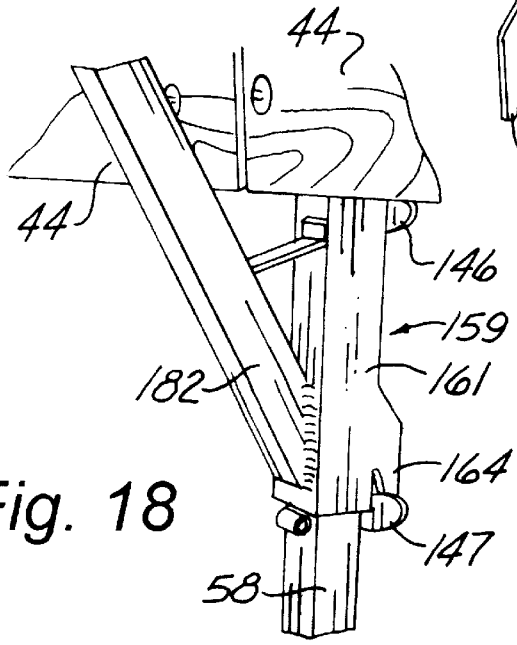
FIG. 18 is a detail, fragmentary perspective view of another accessory leg brace.

In FIG. 18, the bracket (159) has a leg (182) secured to the rear surface of the base (166), which leg (182) (FIG. 1) supports a seat unit (154). FIG. 1 further depicts a personal watercraft or other type dock-mounted hoist assembly (183) secured to the dock, the assembly (183) comprising a pair of bunk supporting frames (184), (186), each with a lift platform (187) movably vertically by a winch and pulley unit (188), the frames (184), (186) interconnected by an elongated adapter (189) which is secured to a sideboard (44) or (46) of one or more dock sections, and to which the frames (184), (186) are connected.

Figure 19:
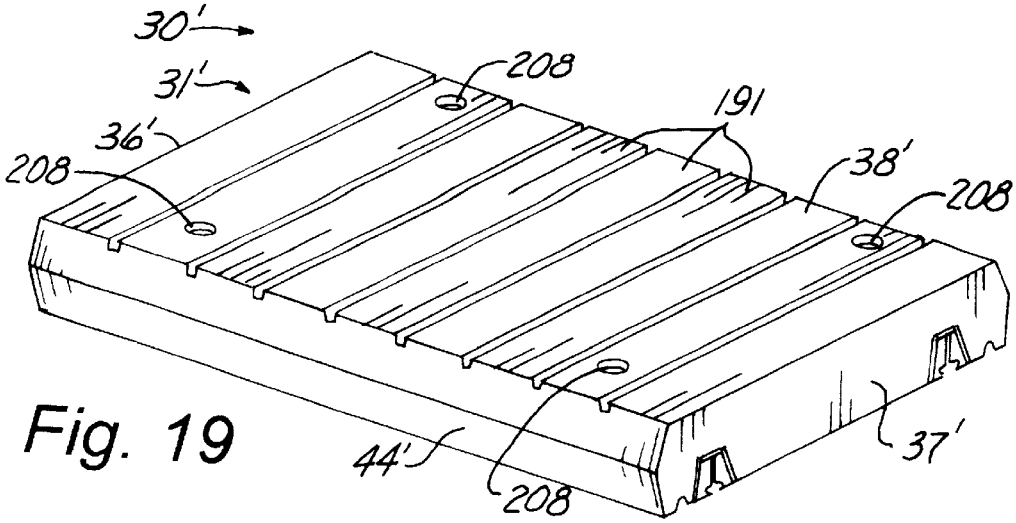
FIG. 19 is a perspective view of a modified dock section, top side up.
Figure 20:
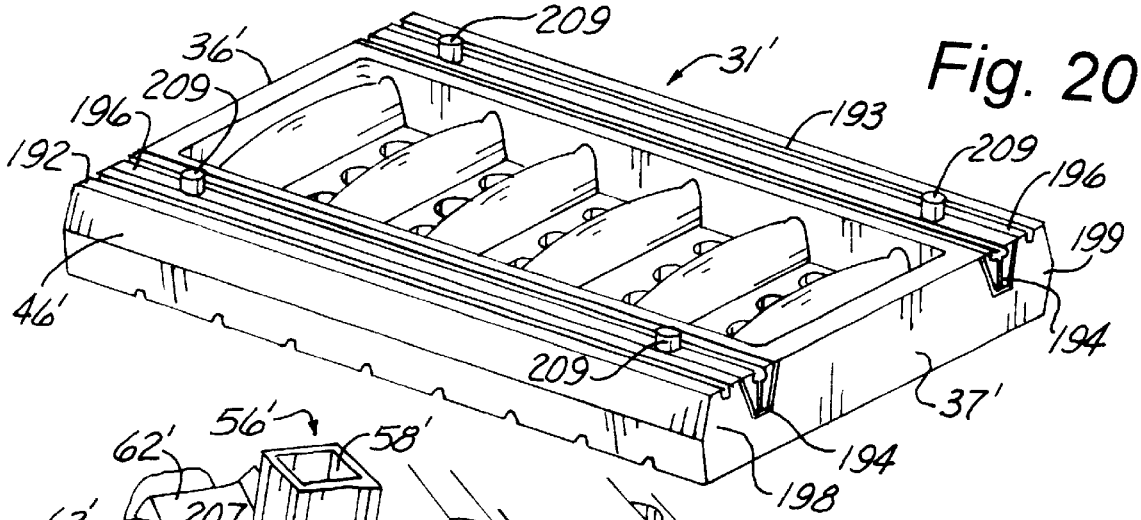
FIG. 20 is a perspective view of the dock section of FIG. 21 in an inverted position.
Figure 21:
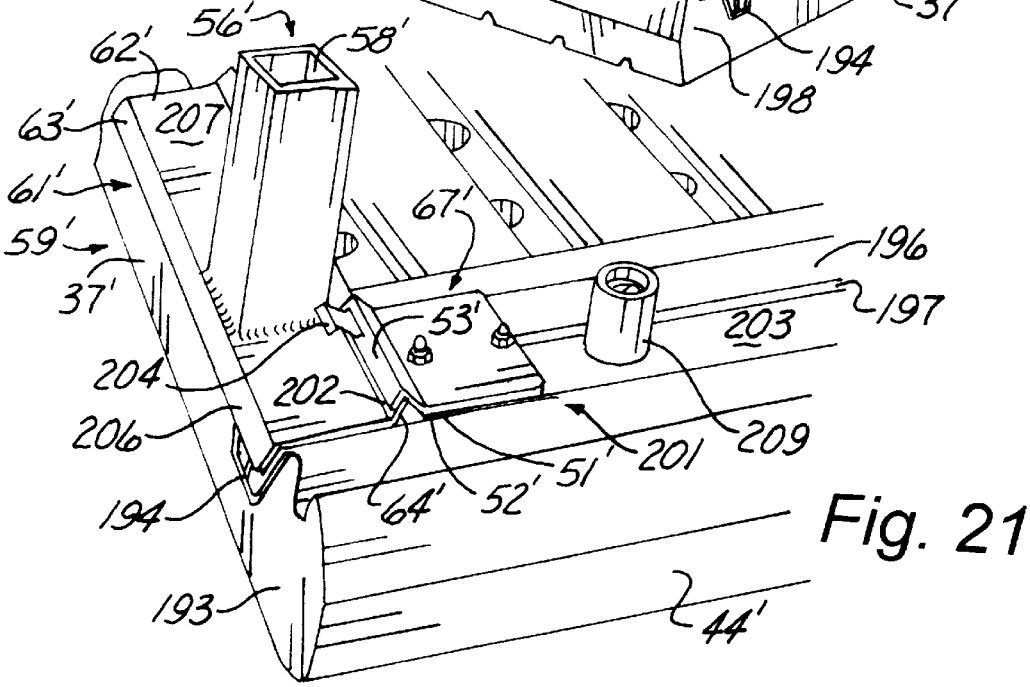
FIG. 21 is an enlarged, fragmentary perspective view of a corner of the inverted dock section of FIG. 20, with an attached leg unit.

Referring to FIGS. 19–21, an alternative dock system (30') is illustrated. As many of the parts of the system (30') are identical to those of system (30), those are referred to by identical reference numbers, with differing parts identified accordingly.

The dock system (30') is also comprised of a plurality of dock sections (31'), and as all sections (31') are identical, only one will be described. Rather than wood, each section (31') is molded of high density polyethylene, and has a plurality of plank-looking members (191) molded in a longitudinal spacing manner along the upper surface (38'), each section having a shoreward end (36') and a lakeward end (37'), with sides (44') and (46').

The bottom of each section (31') has a ribbed arrangement for structural purposes, with spaced side members (192), (193) within each of which a U-shaped channel (194) (FIGS. 20 and 21) is formed the entire length of the section (31'). Within each channel (194), an I-beam extrusion (196) is mounted, each extrusion (196) having a slot (197) (FIG. 20) formed the length thereof. At the shoreward end (36') of each dock section (31'), an elongated plate (not shown) substantially identical to the third member (68) (FIG. 5) of the third assembly (67), except for the side elements (70), is secured transversely across the bottom of the end (36').

At the bottom of the lakeward end (37') of each section (31'), spaced inwardly of the end (37'), and at each corner (198), (199), a bracket (201) (FIG. 21) is secured within the slot (197), which bracket (201), comparable to first bar (47) (FIG. 5), has an angular element (51') with a V-shaped flange (52') formed along its outer end, with the flange (52') having a first portion (53') the edge (202) of which is spaced above, as illustrated in FIG. 21, the exposed surface (203) of the extrusion (196). A tab (204) extends upwardly and outwardly from one end of each bracket (201).

Similar again to the second assembly (59) and the leg units (54), (56) combination of the dock system (30), the second member (61') is provided with a flat portion (62') (FIG. 5), a shoreward flange (63') extended outwardly toward the shoreline and downwardly at an obtuse angle to the flat portion (62'). Extended outwardly and upwardly toward the lake and at an obtuse angle from the flat portion (62') is a lakeward flange (64'). Secured to the flat portion (62'), at each end (206) of the member (61'), a leg unit (56') is connected, the upper end (58') being welded to the portion (62'), spaced inwardly as best illustrated in FIG. 21. The second assembly (59') and leg unit (56') as a combination is connected to the lakeward end (37') of each section (31)') in the same exact manner as described before as to the system (30), it being noted from FIG. 21 that the spacing of the parts provides for the tab (204) to engage the underside (207) of the second member (61') for further securement of the leg unit (56'), and the opposite leg unit (54'), with the dock section (31'). Latching of the second and third assemblies (59') and (67') of the sections (31'), and lengthwise adjustment of the leg units (54') and (56') are accomplished as with their counterpart assemblies of the system (30).

For stacking and shipping purposes, each section (31') has an opening (208) (FIG. 9) formed in the upper surface (38') at each corner. Complementary engagement of each opening (208) is provided by a quartet of circular stacking blocks (209) (FIG. 20), each secured to each end of each extension (196) such as to nest into a respective opening (208) upon the bottom of one section (31') being placed on the top surface (38') of another section (31').

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A portable, modular dock system comprising:

a plurality of rectangular dock sections, each dock section having a shoreward end and a lakeward end opposed to said shoreward end, and having a top surface and a bottom surface;

first means secured to and extended transversely across said lakeward end of each dock section;

a pair of leg units, each having a lake bed engaging foot at a lower end and having an upper end, second means interconnecting said upper ends and clampingly engageable with said first means for releasably securing said leg units to said dock section lakeward end; and third means secured to and extended transversely across said shoreward end of each dock section, said third means engageable with said second means for releasably securing said shoreward end of one dock section into an end-to-end abutting relationship to the lakeward end of another dock section.

2. The dock system of claim 1, and further wherein said first means further comprises an elongated first member secured to said bottom surface and including a first angular element extended downwardly from said bottom surface.

3. The dock system of claim 2, and further wherein said first angular element has a V-shaped flange along one edge thereof, with a first portion of said flange spaced from said bottom surface.

4. The dock system of claim 3, and further wherein said second means comprises further an elongated second member having a shoreward flange, said shoreward flange adapted to engage said first angular element flange.

5. The dock system of claim 4, and further wherein said second member shoreward flange has a second portion adapted to clampingly engage said first portion within said V-shaped flange.

6. The dock system of claim 5 and further wherein said second member having a lakeward flange along an opposite edge thereof, said lakeward flange extended beyond said dock section lakeward end, extended upwardly and spaced outwardly therefrom.

7. The dock system of claim 6 and further wherein said third means further comprises a third member having an inverted U-shaped flange extended transversely of and spaced outwardly of said dock section shoreward end, said first portion of one dock section adapted to extend into and be embraced by said U-shaped flange of an adjacent dock section, whereby said adjacent dock sections respective top surfaces are horizontally aligned.

8. The dock system of claim 7 and further wherein said third means comprises a spring biased plunger manually movable from a first inoperable position to a second operable position engaging said third member and said second member to prevent relative movement therebetween.

9. The dock system of claim 8 and further wherein said third means additionally comprising a second flange depending from said third member and having an opening formed therein, said second member having a tab depending therefrom, with said tab having a notch formed therein, said tab notch and said opening alignable upon said dock sections placed into an end-to-end abutting relationship, whereby said plunger is insertable through said aligned opening and the tab notch in said operable position, said tab preventing said plunger from moving laterally outwardly therefrom, said plunger preventing said tab from moving downwardly therefrom.

10. The dock system of claim 1, and further wherein each leg unit comprises an outer tube having an upper end and a lower end, said upper end secured to said second means, comprising further an inner tube having an upper end telescopically inserted into said outer tube, a lever inserted through said outer and inner tubes and pivotally connected about a horizontal axis to one of said tubes, said lever having an outer end disposed outwardly of said outer tube, and having an inner end spring biased into one position to engage said inner tube, and movable to another position disengaged therefrom, the length of said inner end spaced from said pivotal connection such that attempted upward movement of said inner tube within said outer tube results in an attempted pivotal movement of said lever inner end relative to said inner tube, thereby clampingly engaging said inner tube to said outer tube via said lever.

11. The dock system of claim 10, each leg unit further having a projection formed within said inner tube and engageable with said lever inner end to prevent said inner leg from separating from said outer leg, said lever movable within a plane normal to said pivotal connection to temporarily position said lever inner end away from said projection whereby to permit said inner tube to move further into said outer tube sufficient to position said projection above said lever inner end.

12. The dock system of claim 11 and further wherein each leg unit includes two pair of vertically spaced laterally aligned ears secured to said outer tube, and a bracket having two pairs of vertically spaced, laterally aligned slots, each pair of laterally aligned slots adapted to engage and rest upon a pair of laterally aligned ears, said bracket having an outer end adapted to be secured to and support a boat dock accessory.

13. The dock system of claim 1, and further comprising fourth means mounted on each leg unit, and a dock accessory, said fourth means supporting said dock accessory.

14. The dock system of claim 13, and further wherein said fourth means comprises at least two pairs of vertically spaced projections connected to a leg unit, each pair extended at least to one side of said leg unit.

15. The dock system of claim 14, and further wherein said dock accessory includes at least two pairs of vertically spaced hooks, each pair of hooks adapted to engage and be supported by a respective pair of projections.

* * * * *